US010334992B2

(12) United States Patent
Chau

(10) Patent No.: US 10,334,992 B2
(45) Date of Patent: Jul. 2, 2019

(54) ROTARY UNIT FOR SELECTIVELY ADDING ADDITIVES TO WATER IN A CONVENTIONAL BATHTUB AUTOMATICALLY

(71) Applicant: Wai Kin Chau, Freehold, NJ (US)

(72) Inventor: Wai Kin Chau, Freehold, NJ (US)

( * ) Notice: Subject to any disclaimer, the term of this patent is extended or adjusted under 35 U.S.C. 154(b) by 0 days.

(21) Appl. No.: 15/700,310

(22) Filed: Sep. 11, 2017

(65) Prior Publication Data

US 2019/0075976 A1 Mar. 14, 2019

(51) Int. Cl.

| | |
|---|---|
| ***A47K 3/022*** | (2006.01) |
| ***A47K 3/00*** | (2006.01) |
| *F04D 15/00* | (2006.01) |
| *B65D 83/14* | (2006.01) |
| *A61Q 19/10* | (2006.01) |

(52) U.S. Cl.

CPC ..... *A47K 3/022* (2013.01); *A47K 3/001* (2013.01); *A61Q 19/10* (2013.01); *B65D 83/14* (2013.01); *F04D 15/0027* (2013.01)

(58) Field of Classification Search

CPC ..... A47K 3/001; A47K 5/00; B65D 83/14

USPC ..... 4/559; 134/84

See application file for complete search history.

(56) References Cited

U.S. PATENT DOCUMENTS

| | | | | |
|---|---|---|---|---|
| 3,080,568 | A | 3/1963 | Burnett | |
| 5,025,515 | A | 6/1991 | Rhines | |
| 7,614,570 | B2 * | 11/2009 | Freidell | F04F 5/54 119/665 |
| 9,301,652 | B2 | 4/2016 | Millerd | |
| 2006/0011746 | A1 * | 1/2006 | De Simone | E03C 1/046 239/311 |
| 2006/0282944 | A1 | 12/2006 | Sagi | |
| 2009/0000024 | A1 * | 1/2009 | Louis | E03C 1/046 4/676 |

FOREIGN PATENT DOCUMENTS

| | | |
|---|---|---|
| EP | 0509292 | 10/1992 |

* cited by examiner

*Primary Examiner* — Lauren A Crane

(74) *Attorney, Agent, or Firm* — Charles E. Baxley

(57) ABSTRACT

A rotary unit selectively adds additives to water in a conventional bathtub automatically without a bather having to touch the additives or leave the conventional bathtub to get the additives. The rotary unit includes a plurality of pressurized canisters and a controller. The plurality of pressurized canisters are configured in a circular configuration and are disposed directly adjacent to, and communicatable with, the conventional bathtub. Each pressurized canister contains a different one of the additives. The controller is in communication with the plurality of pressurized canisters, and as such, the controller is utilized to choose one of the additives to add to the water in the conventional bathtub automatically without the bather having to touch the chosen one of the additives or leave the conventional bathtub to get the chosen one of the additives.

28 Claims, 5 Drawing Sheets

ROTARY UNIT FOR SELECTIVELY ADDING ADDITIVES TO WATER IN A CONVENTIONAL BATHTUB AUTOMATICALLY

CROSS REFERENCE TO RELATED APPLICATIONS

The instant non-provisional patent application claims priority from provisional patent application No. 62/602,775, filed on May 5, 2017, under the title of WATER TEMPERATURE MODERATOR, and is incorporated herein in its entirety by reference thereto.

BACKGROUND OF THE INVENTION

Field of the Invention

The embodiments of the present invention relate to a rotary unit for use with a conventional bathtub, and more particularly, the embodiments of the present invention relate to a rotary unit for selectively adding additives to water in a conventional bathtub automatically without a bather having to touch the additives or leave the conventional bathtub to get the additives.

Description of the Prior Art

Numerous innovations for portable showers and baths have been provided in the prior art, which will be described below in chronological order to show advancement in the art, and which are incorporated herein in their entirety by reference thereto. Even though these innovations may be suitable for the specific individual purposes to which they address, nevertheless, they differ from the embodiments of the present invention in that they do not teach a rotary unit for selectively adding additives to water in a conventional bathtub automatically without a bather having to touch the additives or leave the conventional bathtub to get the additives.

U.S. Pat. No. 3,080,568 to Burnett

U.S. Pat. No. 3,080,568—issued to Burnett on Mar. 12, 1963—teaches a portable shower bath assembly including a foldable floor having a plurality of parallel slats and respective link bars hingedly connecting the ends of adjacent slats to each other, a generally rectangular up-standing collapsible frame including vertical corner posts and horizontal connecting bars detachably connected to the top ends of the vertical corner posts, respective, and upstanding sockets on the end portions of the opposite end slats of the floor receiving. The lower ends of the vertical corner posts, a flexible cover surrounding the frame, apparatus for detachably connecting the top margin of the cover to the horizontal connecting bar, apparatus detachably connecting the bottom margin of the cover to the floor slats, whereby to define a shower stall. A shower bath sprinkler head is secured to one of the horizontal connecting bars and is directed downwardly and inwardly into the shower stall, a water tank, apparatus for admitting water into the tank, conduit apparatus for connecting the lower portion of the water tank to the sprinkler head, apparatus for sealing the water tank, and an air inlet check valve on the top of the tank, whereby air may be pumped into the upper portion of the tank to develop a pressure sufficient to force the water in the tank through the conduit apparatus for discharge.

U.S. Pat. No. 5,025,515 to Rhines

U.S. Pat. No. 5,025,515 issued to Rhines on Jun. 25, 1991—teaches a portable bathtub apparatus for facilitating the bathing of bedridden persons. The portable bathtub apparatus includes an inflatable bathtub. An air pump and a tank are provided to inflate the bathtub. A movable water storage tank is coupled to the bathtub by a water pump that facilitates the movement of water from the tank to the bathtub. A heat dispenser is provided to heat the water in the tank so that the water in the bathtub can be maintained at a desired temperature.

European Patent Number EP0509292 to Dieter

European Patent Number EP0509292—issued to Dieter on Oct. 21, 1992—teaches a washing device for patients, which includes a washing mattress that is placed on an ordinary mattress of a bed frame, below a patient to be washed. The washing mattress is of a trough-type construction, so that water passing onto it is able to pass via a water outflow and a hose into a waste water container. The washing water required for washing flows out of a washing water container to a hand-held shower unit.

United States Patent Application Publication Number 2006/0282944 to Sagi

United States Patent Application Publication Number 2006/0282944—published to Sagi on Dec. 21, 2006—teaches an entirely mobile system and method for bathing non-ambulatory patients in the patient's own bed. The system includes a maneuverable cart housing, a clean water supply, and all other necessary apparatus and optional accessories for bathing a patient. A waterproof and disposable bathing sheet is placed over the bed and under the patient, which is manipulated into the shape of a bath.

U.S. Pat. No. 9,301,652 to Millerd

U.S. Pat. No. 9,301,652—issued to Millerd on Apr. 5, 2016—teaches a portable and walk-in type bathtub that includes an entrance and a door attached thereto to allow someone to walk into the bathtub without stepping over a wall. A replaceable water tank is attached to the tub so that clean water is directed from the water tank to the tub. Once the water has been used, the used water is directed to a separate tank within the water tank attachment. Once all of the clean water from the water tank has been used, the water tank is detached from the tub housing and a new tank containing clean water is attached to the tub to further facilitate bathing. The tub and water tank include wheels attached to the bottoms thereof to facilitate movement of the tub and the water tank. The wheels may be raised and lowered to facilitate movement and locking of the tub in place.

It is apparent that numerous innovations for portable showers and baths have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a rotary unit for selectively adding additives to water in a conventional bathtub automatically without a bather having to touch the additives or leave the conventional bathtub to get the additives.

SUMMARY OF THE INVENTION

Thus, an object of the embodiments of the present invention is to provide a rotary unit for selectively adding additives to water in a conventional bathtub automatically without a bather having to touch the additives or leave the conventional bathtub to get the additives, which avoids the disadvantages of the prior art.

Briefly stated, another object of the embodiments of the present invention is to provide a rotary unit that selectively adds additives to water in a conventional bathtub automatically without a bather having to touch the additives or leave the conventional bathtub to get the additives. The rotary unit includes a plurality of pressurized canisters and a controller. The plurality of pressurized canisters are configured in a circular configuration and are disposed directly adjacent to, and are communicatable with, the conventional bathtub. Each pressurized canister contains a different one of the additives. The controller is in communication with the plurality of pressurized canisters, and as such, the controller is utilized to choose one of the additives to add to the water in the conventional bathtub automatically without the bather having to touch the chosen one of the additives or leave the conventional bathtub to get the chosen one of the additives.

The novel features considered characteristic of the embodiments of the present invention are set forth in the appended claims. The embodiments of the present invention themselves, however, both as to their construction and to their method of operation together with additional objects and advantages thereof will be best understood from the following description of the embodiments of the present invention when read and understood in connection with the accompanying figures of the drawing.

BRIEF DESCRIPTION OF THE FIGURES OF THE DRAWING

The figures of the drawing are briefly described as follows.

LIST OF REFERENCE NUMERALS UTILIZED IN THE FIGURES OF THE DRAWING

Introductory

Figure 1:
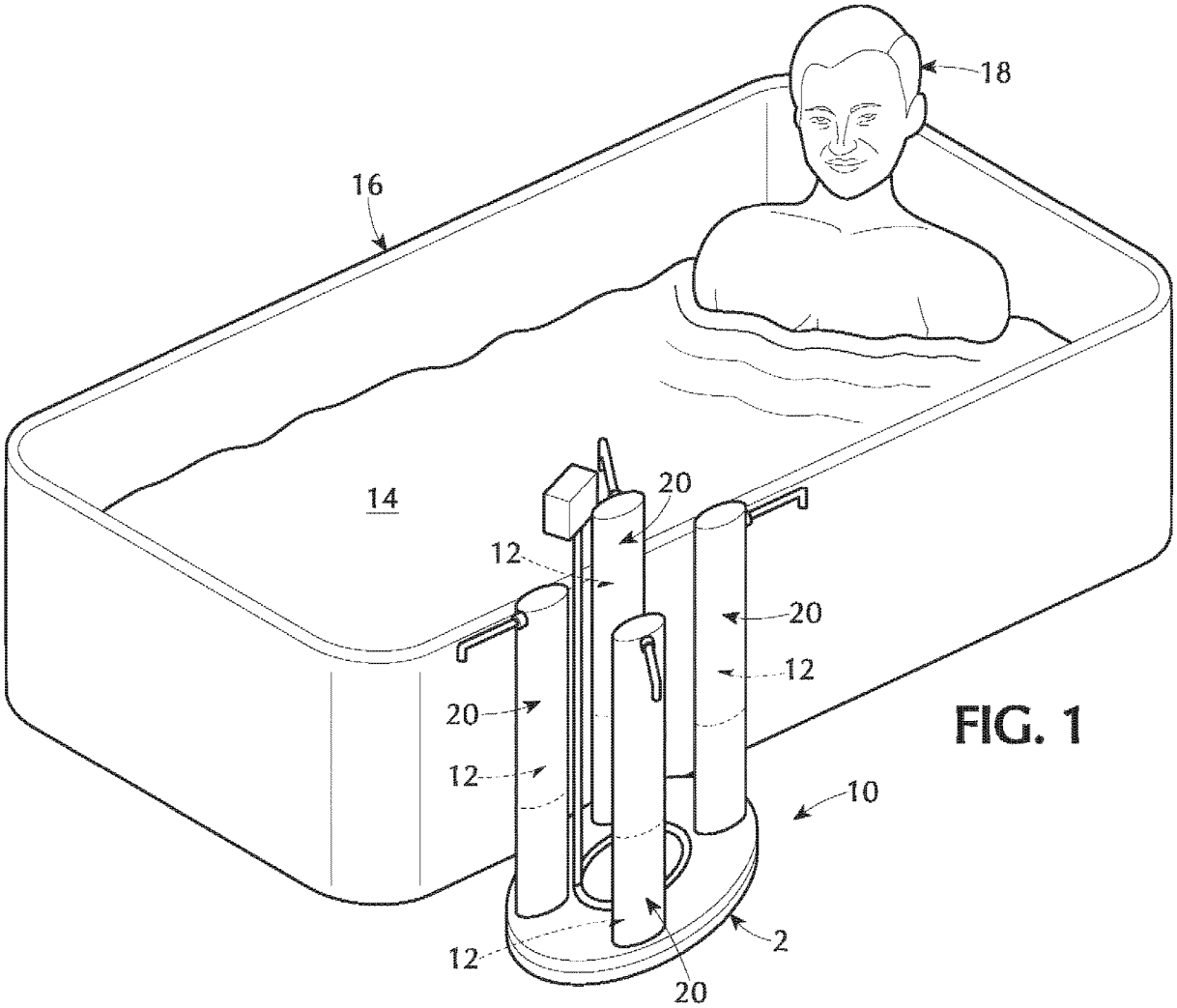
FIG. 1 is a diagrammatic perspective view of the rotary unit of the embodiments of the present invention selectively adding additives to water in a conventional bathtub automatically without a bather having to touch the additives or leave the conventional bathtub to get the additives.

10 rotary unit of embodiments of present invention for selectively adding additives 12 to water 14 in conventional bathtub 16 automatically without bather 18 having to touch additives 12 or leave conventional bathtub 16 to get additives 12
12 additives
14 water
16 conventional bathtub
18 bather

Overall Configuration of Rotary Unit 10

20 plurality of pressurized canisters for disposing directly adjacent to, and communicatable with, conventional bathtub 16
22 controller
24 base for resting on support surface 26
26 support surface
28 rotary motor for selectively rotating portion of base 24
30 portion of base 24
32 pressurizing pump for pressurizing plurality of pressurized canisters 20
34 power source interface for holding batteries 36 for powering rotary unit 10
36 batteries for powering rotary unit 10
38 plurality of dispensers for dispensing additives 12

Specific Configuration of Base 24

40 lower layer of base 24 for resting upon support surface 26
42 upper layer of base 24
44 perimeter of upper layer 42 of base 24
46 central axis of upper layer 42 of base 24
48 through track of upper layer 42 of base 24

Specific Configuration of Plurality of Pressurized Canisters 20

50 bottom end of each pressurized canister of plurality of pressurized canisters 20
52 top end of each pressurized canister of plurality of pressurized canisters 20
54 pressurized air
58 hollow tube of dispenser 38 of each pressurized canister of plurality of pressurized canisters 20
60 proximal end of dispenser 56 of each pressurized canister of plurality of pressurized canisters 20
62 distal end of dispenser 56 of each pressurized canister of plurality of pressurized canisters 20
64 valve

Specific Configuration of Controller 22

66 enclosure of controller 22
68 front control panel of enclosure 66 of controller 22 for facing bathtub 16 for facilitating use by bather 18
70 lower wall of enclosure 66 of controller 22
72 tube stand of controller 22
74 proximal end of tube stand 72 of controller 22
76 distal end of tube stand 72 of controller 22
78 plurality of imaginary columns of front control panel 68 of enclosure 66 of controller 22
80 position button switch of each imaginary column of plurality of imaginary columns 78 of front control panel 68 of enclosure 66 of controller 22
82 activation button switch of each imaginary column of plurality of imaginary columns 78 of front control panel 68 of enclosure 66 of controller 22

84 additive quantity meter of each imaginary column of plurality of imaginary columns 78 of front control panel 68 of enclosure 66 of controller 22 for advising bather 18 amount of additives 12 left in plurality of canisters 20

DETAILED DESCRIPTION OF THE PREFERRED EMBODIMENTS

Introductory

Referring now to the figures, in which like numerals indicate like parts, and particularly to FIG. 1, the rotary unit of the embodiments of the present invention is shown generally at 10 for selectively adding additives 12 to water 14 in a conventional bathtub 16 automatically without a bather 18 having to touch the additives 12 or leave the conventional bathtub 16 to get the additives 12.

It is to be understood that the additives 12 can be hot water, cold water, bubble bath, Epson salts, bath oils, etc.

Overall Configuration of the Rotary Unit 10

Figure 2:
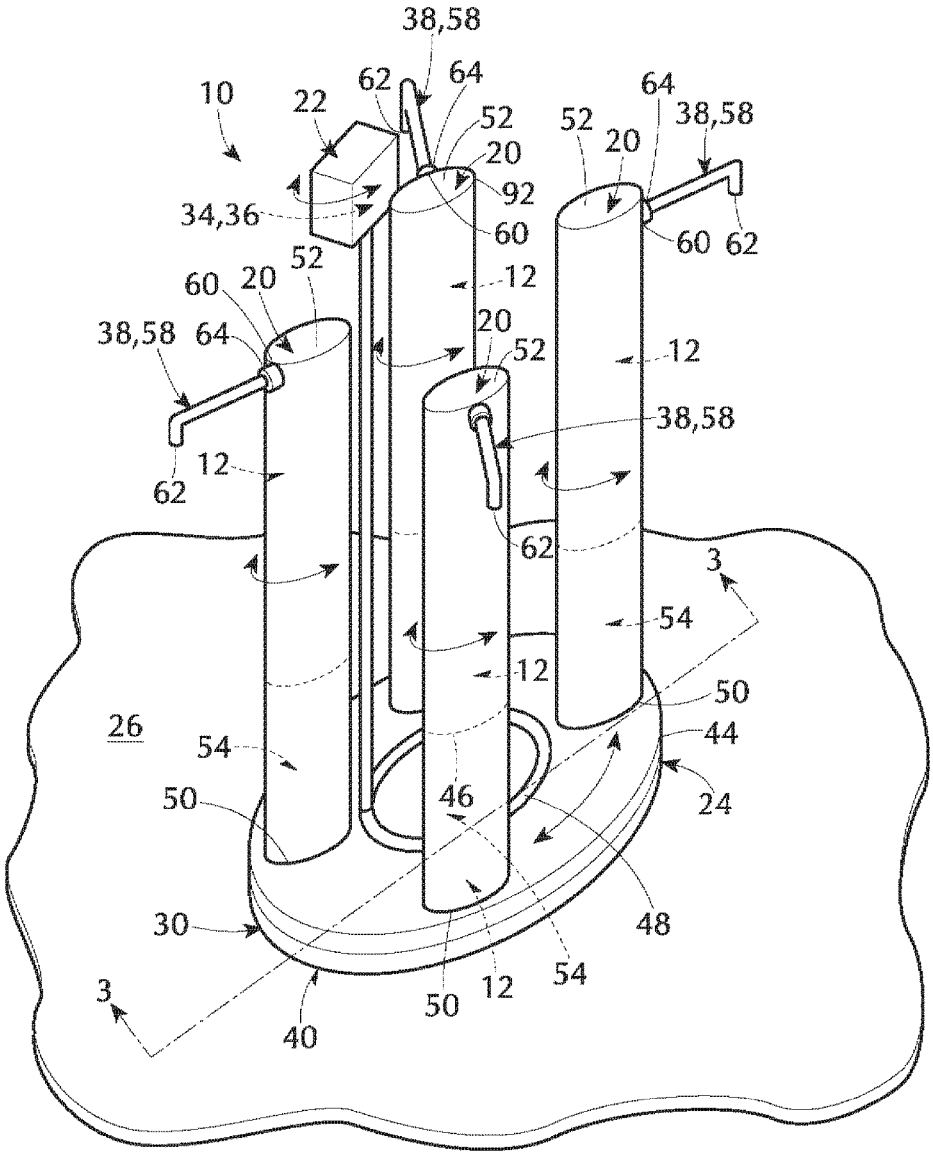
FIG. 2 is enlarged diagrammatic perspective view of the rotary unit of the embodiments of the present invention identified by ARROW 2 in FIG. 1.
Figure 3:
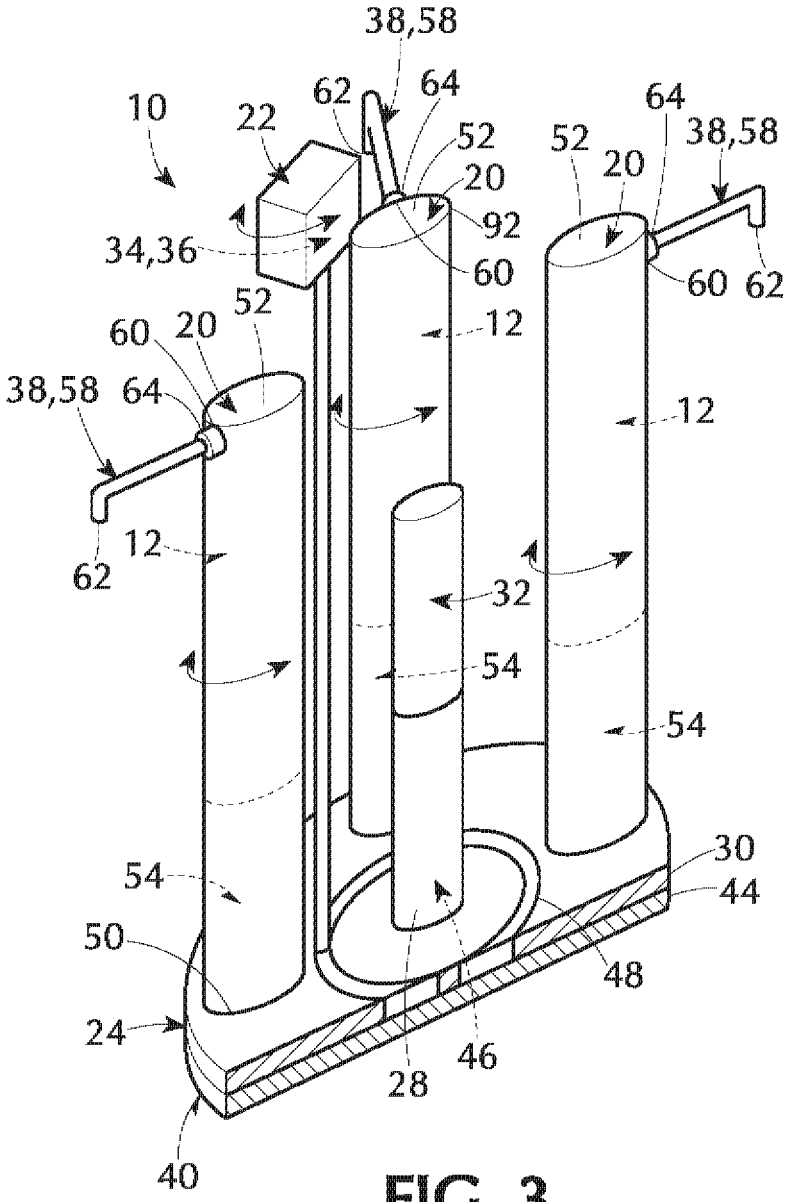
FIG. 3 is a diagrammatic cross sectional view taken along LINE 3-3 in FIG. 2.
Figure 4:
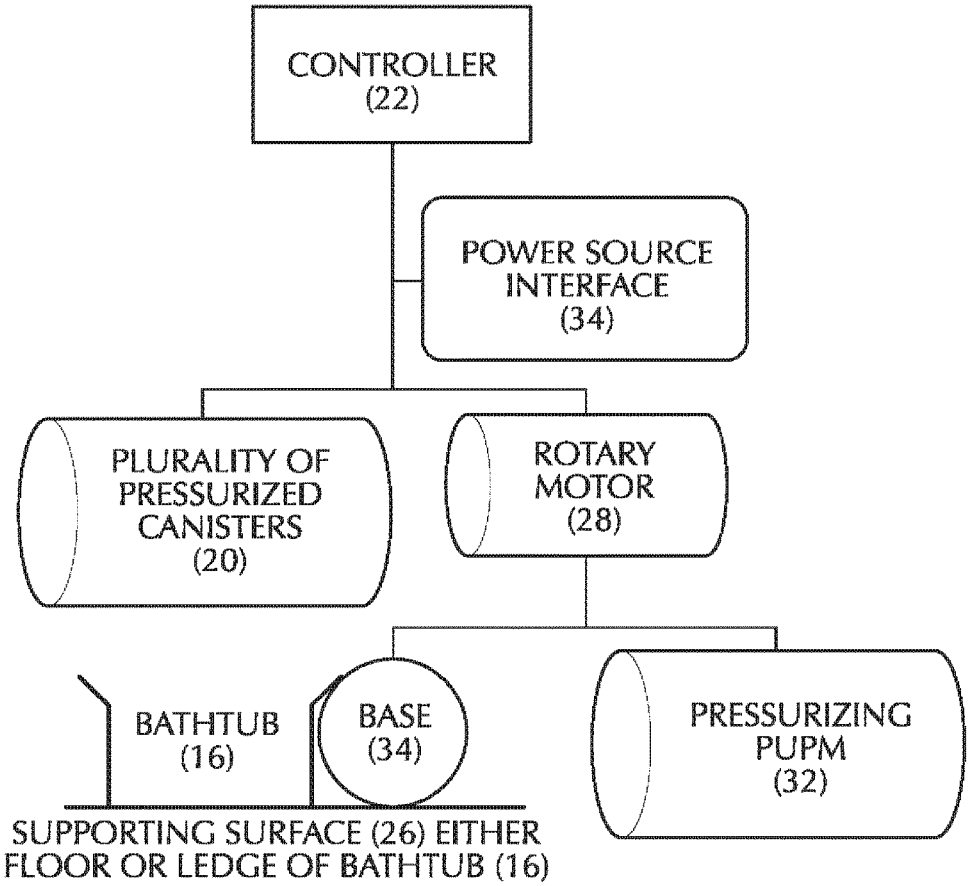
FIG. 4 is a diagrammatic block diagram of the rotary unit of the embodiments of the present invention.

The overall configuration of the rotary unit 10 can best be seen in FIGS. 2, 3, and 4, and as such, will be discussed with reference thereto.

The rotary unit 10 comprises a plurality of pressurized canisters 20 and a controller 22. The plurality of pressurized canisters 20 are configured in a circular configuration, and are for disposing directly adjacent to, and communicatable with, the conventional bathtub 16. Each pressurized canister 20 is for containing a different one of the additives 12. The controller 22 is in communication with the plurality of pressurized canisters 20, and as such, is utilized for choosing the one of the additives 12 that is to be added to the water 14 in the conventional bathtub 16 automatically without the bather 18 having to touch the chosen one of the additives 12 or leave the conventional bathtub 16 to get the chosen one of the additives 12.

The rotary unit 10 further comprises a base 24. The base 24 is for resting on a support surface 26.

It is to be further understood that the rotary unit 10 can be sized so the support surface 26 can be the floor adjacent the bathtub 16, or the rotary unit 10 can be reduced in size and the support surface 26 can be the ledge of the bathtub 16, etc.

The rotary unit 10 further comprises a rotary motor 28. The rotary motor 28 is attached to the base 24, and is for selectively rotating a portion 30 of the base 24.

The rotary unit 10 further comprises a pressurizing pump 32. The pressurizing pump 32 is operatively connected to the rotary motor 28, and is for pressurizing the plurality of pressurized canisters 20.

The rotary unit 10 further comprises a power source interface 34. The power source interface 34 is contained within the controller 22, and is for holding batteries 36 for powering the rotary unit 10.

The rotary unit 10 further comprises a plurality of dispensers 38. The plurality of dispensers 38 are operatively connected to the plurality of pressurized canisters 20, respectively, and are for dispensing the additives 12 on demand, respectively.

Specific Configuration of the Base 24

The specific configuration of the base 24 can best be seen in FIGS. 2 and 3, and as such, will be discussed with reference thereto.

The base 24 comprises a lower layer 40 and an upper layer 42.

The upper layer 42 of the base 24 is circular-shaped, has a perimeter 44 and a central axis 46, and rotates about the central axis 46 of the upper layer 42 of the base 24.

The upper layer 42 of the base 24 further has a through track 48. The through track 48 of the upper layer 42 of the base 24 extends completely therethrough, is disposed inward of, and is concentric with, the perimeter 44 of the upper layer 42 of the base 24.

The lower layer 40 of the base 24 is circular-shaped, is aligned with, is disposed directly below, and is identical in size as, the upper layer 42 of the base 24, and is for resting upon the support surface 26. The lower layer 40 of the base 24 is stationary as the upper layer 42 of the base 24 rotates relative thereto.

Specific Configuration of the Plurality of Pressurized Canisters 20

The specific configuration of the plurality of pressurized canisters 20 can best be seen in FIGS. 2 and 3, and as such, will be discussed with reference thereto.

Each pressurized canister 20 is pressurized, is cylindrically shaped, is vertically oriented, has a bottom end 50 and a top end 52, and extends upwardly from the bottom end 50 of an associated canister 20, from the upper layer 42 of the base 24.

The plurality of pressurized canisters 20 are disposed in a circle about the base 24, just inwardly of the perimeter 44 of the upper layer 42 of the base 24.

Each pressurized canister 20 is for containing both the additive 12 associated therewith and the pressurized air 54 provided by the pressurizing pump 32. The pressurized air 54 is for disposing below the additive 12 so as to provide dispensing pressure when that canister 20 is called into action.

Each pressurized canister 20 has the dispenser 38. The dispenser 38 is a slender, elongated, and hollow tube 58, and has a proximal end 60 and a distal end 62.

The proximal end 62 of the dispenser 38 is mounted to the top end 52 of, and fluidly communicates with, an associated canister 20, and can pivot up for an in-use position and pivot down for a not-in-use position. For safety purposes, the dispenser 38 will not dispense its additive 12 when the dispenser 38 is in the not-in-use position thereof.

In the in-use position of the dispenser 38 of an associated canister 20, the dispenser 38 is pivoted upwardly for positioning over the bathtub 16 and is ready to dispense into the bathtub 16 the additive 12 that the associated canister 20 is carrying.

Each pressurized canister 20 further has a valve 64. The valve 64 of each pressurized canister 20 is disposed on the dispenser 38 of an associated canister 20, at the proximal end 60 of said dispenser 38 of the associated canister 20, and is for allowing the additive 12 contained in the associated canister 20 to either communicate through the dispenser 38 of the associated canister 20 and be dispensed through the dispenser 38 of the associated canister 20 and into the bath tub 16 or not communicating through the dispenser 38 of the associated canister 20 and not be dispensed through the dispenser 38 of the associated canister 20.

The Specific Configuration of the Controller 22

Figure 5:
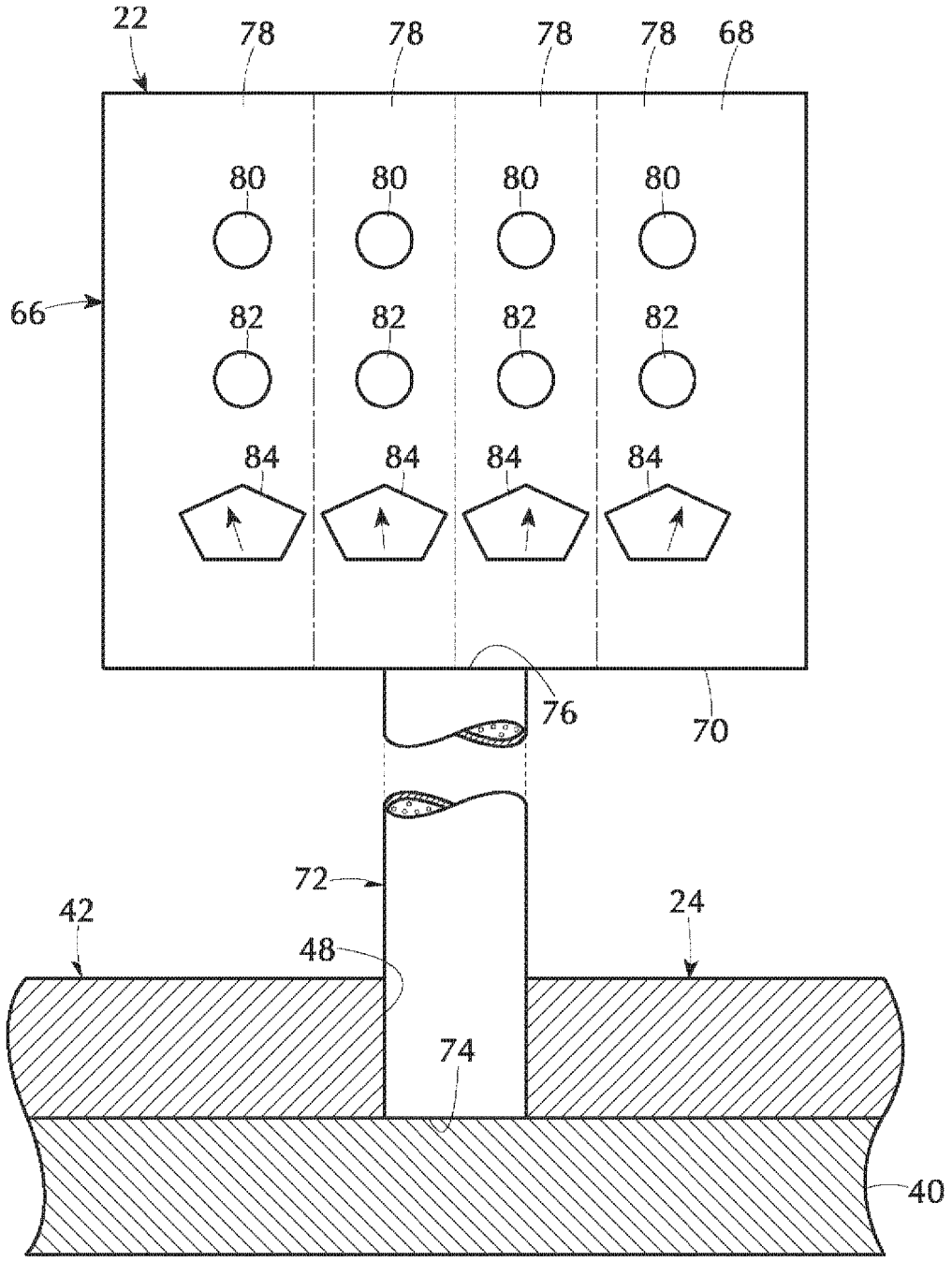
FIG. 5 is a diagrammatic front elevational view of the controller.

The specific configuration of the controller 22 can best be seen in FIG. 5, and as such, will be discussed with reference thereto.

The controller 22 includes an enclosure 66. The enclosure 66 of the controller 22 has a front control panel 68 and a lower wall 70.

The controller 22 further includes a tube stand 72. The tube stand 72 of the controller 22 has a proximal end 74 and a distal end 76, and carries communication between the control panel 68 of the enclosure 66 of the controller 22 to the plurality of pressurized canisters 20, the rotary motor 28, and the pressurizing pump 32, etc.

The proximal end 74 of the tube stand 72 of the controller 22 is disposed movably in the through track 48 of the upper layer 42 of the base 24, is fixed to the lower layer 40 of the base 24, and extends vertically upwardly therefrom to the distal end 76 of the tube stand 72 of the controller 22, which is affixed to the lower wall 70 of the enclosure 66 of the controller 22, and with the front control panel 68 of the enclosure 66 of the controller 22 for facing the bathtub 16 for facilitating use by the bather 18.

The front control panel 68 of the enclosure 66 of the controller 22 is divided into a plurality of imaginary columns 78. Each imaginary column 78 of the front control panel 68 of the enclosure 66 of the controller 22 is associated with a respective pressurized canister 20.

Each imaginary column 78 of the front control panel 68 of the enclosure 66 of the controller 22 has a position button switch 80. The position button switch 80 of each imaginary column 78 of the front control panel 68 of the enclosure 66 of the controller 22 is in electrical communication with the rotary motor 28. When the position button switch 80 of an imaginary column 78 of the front control panel 68 of the enclosure 66 of the controller 22 is pressed, the rotary motor 28 activates and turns the lower layer 40 of the base 24 into a position where the dispenser 38 of the associated canister 20 is for facing into the bathtub 16.

Each imaginary column 78 of the front control panel 68 of the enclosure 66 of the controller 22 further has an activation button switch 82. The activation button switch 82 of each imaginary column 78 of the front control panel 68 of the enclosure 66 of the controller 22 is disposed below the position button switch 80 of the imaginary column 78 of the front control panel 68 of the enclosure 66 of the controller 22, respectively, and is in electrical communication with the valve 64 of an associated canister 20. When the activation button switch 82 of the associated imaginary column 78 of the front control panel 68 of the enclosure 66 of the controller 22 is pressed, the dispenser 38 associated therewith is raised, and the valve 64 of the dispenser 38 of the associated canister 20 opens and the dispenser 38 dispenses the associated additive 12 into the bathtub 16.

And when the activation button switch 82 of the associated imaginary column 78 of the front control panel 68 of the enclosure 66 of the controller 22 is released, the valve 64 of the dispenser 38 of the associated canister 20 closes and stops the dispenser 38 from dispensing the associated additive 12 into the bathtub 16, and the dispenser 38 associated therewith drops.

Each imaginary column 78 of the front control panel 68 of the enclosure 66 of the controller 22 further has an additive quantity meter 84. The additive quantity meter 84 of each imaginary column 78 of the front control panel 68 of the enclosure 66 of the controller 22 is disposed below the activation button switch 82 of an associated imaginary column 78 of the front control panel 68 of the enclosure 66 of the controller 22, and is in electrical communication with an associated canister 20 for advising the bather 18 the amount of additives 12 left in the plurality of canisters 20.

IMPRESSIONS

It will be understood that each of the elements described above, or two or more together, may also find a useful application in other types of constructions differing from the types described above.

While the embodiments of the present invention have been illustrated and described as embodied in a rotary unit for selectively adding additives to water in a conventional bathtub automatically, nevertheless, they are not limited to the details shown, since it will be understood that various omissions, modifications, substitutions, and changes in the forms and details of the embodiments of the present invention illustrated and their operation, can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A rotary unit for selectively adding additives to water in a bathtub automatically without a bather having to touch the additives or leave the bathtub to get the additives, comprising:

a) a plurality of pressurized canisters; and b) a controller;

wherein said plurality of pressurized canisters are configured in a circular configuration;

wherein said plurality of pressurized canisters are for disposing directly adjacent to, and communicatable with, the bathtub;

wherein each pressurized canister is for containing a different one of the additives; and wherein the controller is in communication with said plurality of pressurized canisters, and as such, said controller is utilized for choosing one of the additives to add to the water in the bathtub automatically.

2. The rotary unit of claim 1, further comprising a base; and wherein said base is for resting on a support surface.

3. The rotary unit of claim 2, further comprising a rotary motor;

wherein said rotary motor is attached to said base; and wherein said rotary motor is for selectively rotating a portion of said base.

4. The rotary unit of claim 3, further comprising a pressurizing pump;

wherein said pressurizing pump is operatively connected to said rotary motor; and wherein said pressurizing pump is for pressurizing said plurality of pressurized canisters.

5. The rotary unit of claim 1, further comprising a power source interface;

wherein said power source interface is contained within said controller; and wherein said power source interface is for holding batteries for powering said rotary unit.

6. The rotary unit of claim 4, further comprising a plurality of dispensers;

wherein said plurality of dispensers are operatively connected to the plurality of pressurized canisters, respectively; and wherein said plurality of dispensers are for dispensing the additives on demand, respectively.

7. The rotary unit of claim 6, wherein said base comprises:

a) a lower layer; and b) an upper layer;

wherein said lower layer of said base is for resting upon the support surface.

8. The rotary unit of claim 7, wherein said upper layer of said base is circular-shaped;

wherein said upper layer of said base has a perimeter;

wherein said upper layer of said base has central axis; and wherein said upper layer of said base rotates about said central axis of said upper layer of said base.

9. The rotary unit of claim 8, wherein said upper layer of said base has a through track;

wherein said through track of said upper layer of said base extends completely therethrough;

wherein said through track of said upper layer of said base is disposed inward of said perimeter of said upper layer of said base; and, wherein said through track of said upper layer of said base is concentric with said perimeter of said upper layer of said base.

10. The rotary unit of claim 7, wherein said lower layer of said base is circular-shaped.

11. The rotary unit of claim 8, wherein said lower layer of said base is aligned with said upper layer;

wherein said lower layer of said base is disposed directly below said upper layer of said base; and wherein said lower layer of said base is identical in size as said upper layer of said base.

12. The rotary unit of claim 7, wherein said lower layer of said base is stationary as said upper layer of said base rotates relative thereto.

13. The rotary unit of claim 7, wherein each pressurized canister is pressurized;

wherein each pressurized canister is cylindrically shaped;

wherein each pressurized canister is vertically oriented;

wherein each pressurized canister has a bottom end;

wherein each pressurized canister has a top end; and wherein each pressurized canister extends upwardly from said bottom end of an associated canister, from said upper layer of said base.

14. The rotary unit of claim 7, wherein said plurality of pressurized canisters are disposed in a circle about said base; and wherein said plurality of pressurized canisters are disposed just inwardly of said perimeter of said upper layer of said base.

15. The rotary unit of claim 4, wherein each pressurized canister is for containing both the additive associated therewith and said pressurized air provided by said pressurizing pump.

16. The rotary unit of claim 15, wherein said pressurized air is for disposing below the additive so as to provide a dispensing pressure when a canister is called into action.

17. The rotary unit of claim 9, wherein each pressurized canister has a dispenser;

wherein each dispenser is elongated;

wherein each dispenser is a hollow tube;

wherein each dispenser has a proximal end; and wherein each dispenser has a distal end.

18. The rotary unit of claim 17, wherein said proximal end of each dispenser is mounted to said top of, and fluidly communicates with, an associated canister, and can pivot up for an in-use position and pivot down for a not-in-use position; and wherein for safety purposes, said dispenser will not dispense its additive when said dispenser is in said not-in use position thereof.

19. The rotary unit of claim 18, wherein in said in-use position of said dispenser of an associated canister, said dispenser is pivoted upwardly for positioning over the bathtub and being ready to dispense the additive that said associated canister is carrying into the bathtub.

20. The rotary unit of claim 17, wherein each pressurized canister has a valve;

wherein said valve is disposed on an associated dispenser, at said proximal end of said associated dispenser of said associated canister; and wherein the additive contained in the pressurized canister is either for communicating through said associated dispenser and be dispensed through said associated dispenser and into the bathtub or not communicate through said associated dispenser and not be dispensed through said associated dispenser.

21. The rotary unit of claim 20, wherein said controller includes an enclosure;

wherein said enclosure of said controller has:

a) a front control panel; and b) a lower wall.

22. The rotary unit of claim 21, wherein said controller includes a tube stand;

wherein said tube stand of said controller has:

a) a proximal end; and b) a distal end;

wherein said tube stand carries communication from said control panel of said enclosure of said controller to at least said plurality of pressurized canisters, said rotary motor, and said pressurizing pump.

23. The rotary unit of claim 22, wherein said proximal end of said tube stand of said controller is disposed movably in said through track of said upper layer of said base;

wherein said proximal end of said tube stand of said controller is fixed to said lower layer of said base;

wherein said tube stand of said controller extends vertically upwardly from said lower layer of said base to said distal end of said tube stand of said controller;

wherein said distal end of said tube stand of said controller is affixed to said lower wall of said enclosure of said controller; and wherein said front control panel of said enclosure of said controller is for facing the bathtub for facilitating use by the bather.

24. The rotary unit of claim 21, wherein said front control panel of said enclosure of said controller is divided into a plurality of imaginary columns; and wherein each imaginary column of said front control panel of said enclosure of said controller is associated with a respective pressurized canister.

25. The rotary unit of claim 24, wherein each imaginary column of said front control panel of said enclosure of said controller has a position button switch;

wherein said position button switch of each imaginary column of said front control panel of said enclosure of said controller is in electrical communication with said rotary motor; and wherein when said position button switch of an imaginary column of said front control panel of said enclosure of said controller is pressed, said rotary motor activates and turns said lower layer of said base into a position where said dispenser of said associated canister is for facing into the bathtub.

26. The rotary unit of claim 25, wherein each imaginary column of said front control panel of said enclosure of said controller has an activation button switch;

wherein said activation button switch of each imaginary column of said front control panel of said enclosure of said controller is disposed below said position button switch of said imaginary column of said front control panel of said enclosure of said controller, respectively;

wherein said activation button switch of each imaginary column of said front control panel of said enclosure of said controller is in electrical communication with said valve of an associated canister; and wherein when said activation button switch of said associated imaginary column of said front control panel of said enclosure of said controller is pressed, said dispenser associated therewith is raised, and said valve of said dispenser of said associated canister opens and said dispenser dispenses the associated additive into the bathtub.

27. The rotary unit of claim 26, wherein when said activation button switch of said associated imaginary column of said front control panel of said enclosure of said controller is released, said valve of said dispenser of said associated canister closes and stops said dispenser from dispensing the associated additive into the bathtub, and said dispenser associated therewith drops down.

28. The rotary unit of claim 26, wherein each imaginary column of said front control panel of said enclosure of said controller has an additive quantity meter;

wherein said additive quantity meter of each imaginary column of said front control panel of said enclosure of said controller is disposed below said activation button switch of an associated imaginary column of said front control panel of said enclosure of said controller; and wherein said additive quantity meter of each imaginary column of said front control panel of said enclosure of said controller is in electrical communication with an associated canister for advising the bather an amount of additives left in said plurality of canisters.

* * * * *